US009367022B2

(12) United States Patent
Kawashima et al.

(10) Patent No.: US 9,367,022 B2
(45) Date of Patent: Jun. 14, 2016

(54) TONER CONVEYANCE DEVICE AND IMAGE FORMING APPARATUS INCORPORATING SAME

(71) Applicants: Yuta Kawashima, Kanagawa (JP); Satoshi Hatori, Kanagawa (JP); Takeshi Fukao, Kanagawa (JP); Hideyasu Seki, Chiba (JP)

(72) Inventors: Yuta Kawashima, Kanagawa (JP); Satoshi Hatori, Kanagawa (JP); Takeshi Fukao, Kanagawa (JP); Hideyasu Seki, Chiba (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/680,300

(22) Filed: Apr. 7, 2015

(65) Prior Publication Data

US 2015/0301496 A1 Oct. 22, 2015

(30) Foreign Application Priority Data

Apr. 18, 2014 (JP) ..... 2014-086600

(51) Int. Cl.
*G03G 21/10* (2006.01)

(52) U.S. Cl.
CPC ..... *G03G 21/105* (2013.01)

(58) Field of Classification Search
CPC ..... G03G 15/0981; G03G 21/105
See application file for complete search history.

(56) References Cited

U.S. PATENT DOCUMENTS

| | | | | |
|---|---|---|---|---|
| 5,708,952 | A * | 1/1998 | Taniguchi | G03G 15/0822 399/120 |
| 2008/0069614 | A1 | 3/2008 | Shintani et al. | |
| 2009/0142115 | A1 | 6/2009 | Muraishi et al. | |
| 2009/0185842 | A1 | 7/2009 | Hatori et al. | |
| 2010/0316422 | A1 | 12/2010 | Amemiya et al. | |
| 2011/0026992 | A1 | 2/2011 | Shintani et al. | |
| 2011/0097124 | A1 | 4/2011 | Koike et al. | |
| 2011/0274447 | A1 | 11/2011 | Arai et al. | |
| 2013/0216288 | A1 * | 8/2013 | Murata | G03G 21/105 399/358 |
| 2014/0010579 | A1 | 1/2014 | Yoshino et al. | |
| 2014/0147170 | A1 | 5/2014 | Taguchi et al. | |

FOREIGN PATENT DOCUMENTS

| | | |
|---|---|---|
| JP | 2003-345201 | 12/2003 |
| JP | 2007-193376 | 8/2007 |

* cited by examiner

*Primary Examiner* — Gregory H Curran
(74) *Attorney, Agent, or Firm* — Harness Dickey & Pierce PLC

(57) ABSTRACT

A toner conveyance device includes a conveyance channel through which toner is transported, communicating with a conveyance origin and a destination container disposed inside an image forming apparatus, a conveyor disposed in the conveyance channel to rotate in the conveyance channel, a driving source to drive the conveyor; and a slide-assist sheet attached to an inner face of the conveyance channel positioned facing the conveyor.

15 Claims, 5 Drawing Sheets

TONER CONVEYANCE DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2014-086600, filed on Apr. 18, 2014, in the Japan Patent Office, the entire disclosure of which is hereby incorporated by reference herein.

BACKGROUND

1. Technical Field

Embodiments of the present invention generally relate to a toner conveyance device and an image forming apparatus, such as, a copier, a printer, a facsimile machine, a plotter, or a multifunction peripheral (i.e., multifunction machine or MFP) having at least two of copying, printing, facsimile transmission, plotting, and scanning capabilities, that includes the toner conveyance device.

2. Description of the Related Art

Image forming apparatuses, such as printers, facsimile machines, copiers, and multifunction peripherals (MFPs), typically include an image bearer to bear a toner image and a cleaning device to collect toner from the image bearer. Image forming apparatuses further include a toner conveyance device to transport toner collected by the cleaning device to a waste-toner container disposed in a body of the image forming apparatus (hereinafter "apparatus body"). For example, the toner conveyance device includes a conveyance channel that communicates with the cleaning device and the waste-toner container, a rotatable conveyor disposed in the conveyance channel, and a driving source to drive the conveyor, thereby transporting the collected toner from the cleaning device to the waste-toner container.

SUMMARY

An embodiment of the present invention provides a toner conveyance device to transport toner from a conveyance origin to a destination container disposed inside an image forming apparatus. The toner conveyance device includes a conveyance channel, communicating with the conveyance origin and the destination container, through which toner is transported, a conveyor disposed in the conveyance channel to rotate in the conveyance channel, a driving source to drive the conveyor, and a slide-assist sheet attached to an inner face of the conveyance channel positioned facing the conveyor.

In another embodiment, an image forming apparatus includes an image bearer, an image forming device to form a toner image on the image bearer, a collecting device to collect toner from the image bearer, a collected-toner container disposed inside a body of the image forming apparatus, to contain toner collected by the collecting device, and the above-described toner conveyance device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
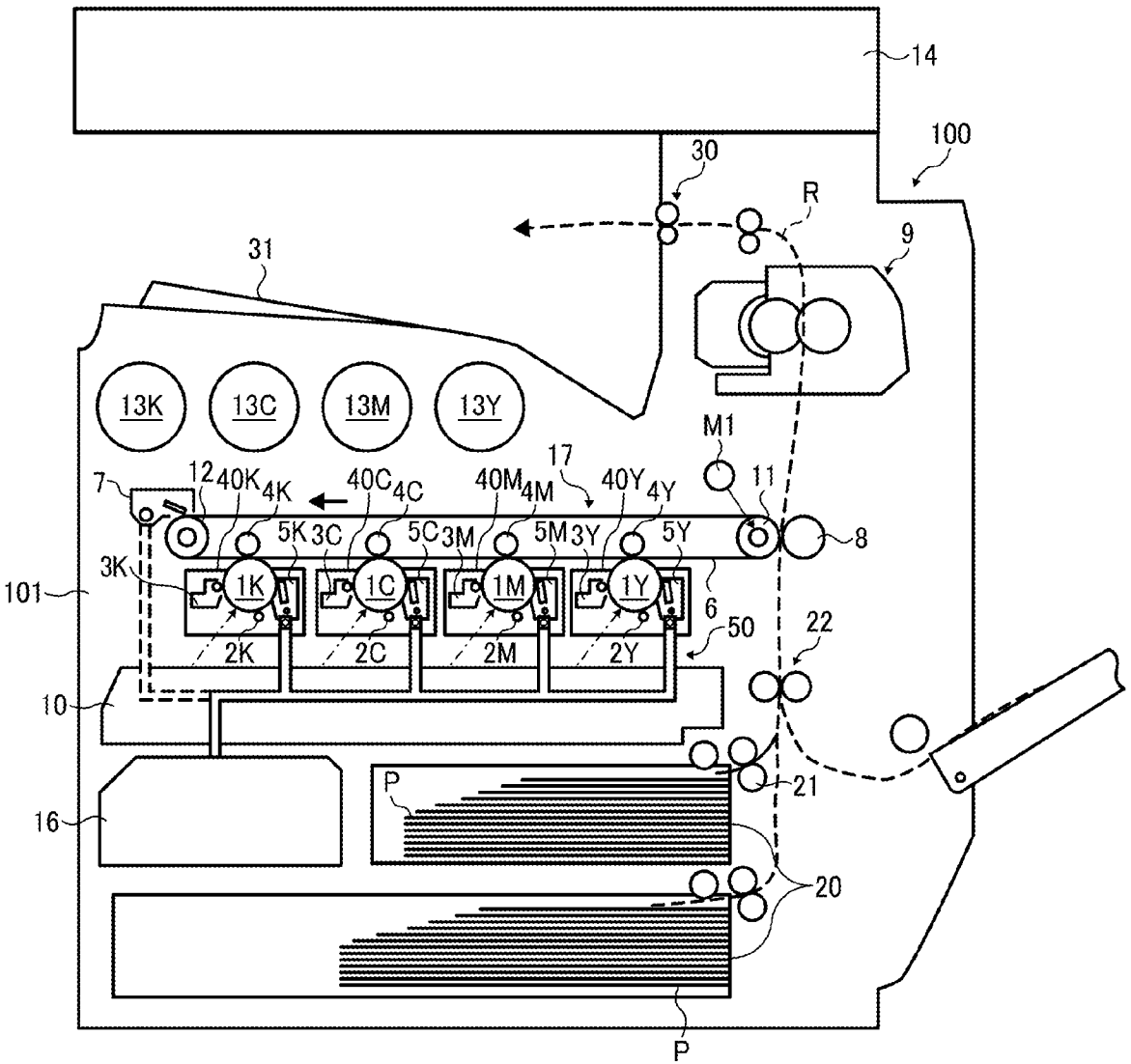
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In toner conveyance devices to transport by rotation of a conveyor disposed in a conveyance channel, it is possible that noise is generated by contact between the conveyor and an inner face of the conveyance channel.

The conveyor that contacts the inner face of the conveyance channel may be lubricated to make sliding contact of the conveyor on the inner face smooth. The inventors, however, recognize that it is possible that lubricant applied is not uniform, and further lubricating property of the lubricant is degraded over time.

According to embodiments described below, occurrence of noise from the conveyance channel through which toner is transported is inhibited for a long time.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a schematic view of an image forming apparatus 100 including a toner conveyance device 50 according to an embodiment.

In the description below, the image forming apparatus 100 is a multicolor digital multifunction peripheral, for example. The image forming apparatus 100 includes four process cartridges 40Y, 40M, 40C, and 40K for forming yellow (Y), magenta (M), cyan (C), and black (B) toner images. The image forming apparatus 100 employs a tandem system, and, inside an apparatus body 101 of the image forming apparatus 100, the process cartridges 40Y, 40M, 40C, and 40K are arranged serially in a direction in which an intermediate transfer belt 6 of an intermediate transfer unit 17 rotates. The intermediate transfer belt 6 serves as both of an image bearer and an intermediate transfer member. It is to be noted that the suffixes Y, M, C, and K, each representing the color of toner, may be omitted below.

The process cartridges 40 are removably installable in the apparatus body 101. Each of the process cartridges 40 includes a drum-shaped photoconductor 1 serving as an image bearer, a charging device 2, a developing device 3 to develop a latent image on a surface of the photoconductor 1 with powdered toner into a toner image, and a photoconductor cleaning device 5 to remove toner (i.e., residual toner) remaining on the surface of the photoconductor 1. Each of the process cartridges 40 is disposed so that the photoconductor 1 contacts a lower side of the intermediate transfer belt 6 in FIG. 1. An exposure device 10 disposed beneath the process cartridges 40 in FIG. 1 emits laser beams to the photoconductors 1 to form latent images corresponding to the respective colors thereon.

Above the apparatus body 101, a scanner 14 (i.e., a reading device) to read images of documents are provided. The image read by the scanner 14 is decomposed into yellow, magenta, cyan, and black color data and transmitted to the exposure device 10. When the image forming apparatus 100 is capable of facsimile transmission or connectable to computers with either cable networks or wireless networks, the image forming apparatus 100 may be configured to decompose data transmitted from facsimile machine or computers into yellow, magenta, cyan, and black color data and transmit the respective color data to the exposure device 10.

The photoconductor cleaning device 5 according to the present embodiment is a blade-type toner collecting device and includes a cleaning blade to contact the surface of the photoconductor 1 to scrape off toner from the photoconductor 1. Cleaning type thereof is not limited to blade type. Instead, a fur brush roller or a magnetic brush may be used. Additionally, the exposure device 10 is not limited to laser type but may include a light-emitting diode (LED) to emit light.

In the image forming apparatus 100, the charging device 2 charges the surface of the photoconductor 1 uniformly. The charged surface of the photoconductor 1 is irradiated with exposure light for each color emitted from the exposure device 10, and a latent image is formed thereon. Then, the developing device 3 develops the latent image with toner into a single-color toner image. The single-color toner images on the photoconductors 1 are transferred therefrom and superimposed one on another on the intermediate transfer belt 6, thus forming a multicolor toner image.

The intermediate transfer belt 6 inside the apparatus body 101 is looped around multiple rollers including a driving roller 11 and a driven roller 12 and rotatable counterclockwise in FIG. 1. The driving roller 11 is driven by a motor M1. Inside the loop of the intermediate transfer belt 6, primary-transfer rollers 4Y, 4M, 4C, and 4K are disposed to face the photoconductors 1Y, 1M, 1C, and 1K, respectively. Outside the loop of the intermediate transfer belt 6, a belt cleaner 7 is disposed to face the driven roller 12. The belt cleaner 7 serves as a toner collecting device to remove residual toner on the intermediate transfer belt 6.

A secondary-transfer roller 8 is disposed, outside the loop of the intermediate transfer belt 6, to face the driving roller 11. The secondary-transfer roller 8 contacts the intermediate transfer belt 6. A nip between the secondary-transfer roller 8 and the intermediate transfer belt 6 is called a secondary-transfer nip. In the present embodiment, a transfer bias is applied to the secondary-transfer roller 8. Instead of a contact-type transfer member, a transfer charger including a contactless corona discharger may be used.

Multiple sheet feeding trays 20 are provided in a lower portion of the image forming apparatus 100. Sizes of sheets P of recording media, respectively contained in the multiple sheet feeding trays 20, are different. The sheet P is fed from the sheet feeding tray 20 by a sheet feeder including a feed roller and a separation roller, transported by a pair of sheet feeding rollers 21, and then reaches a pair of registration rollers 22. After skew of the sheet P is corrected, the registration rollers 22 transport the sheet P to the secondary-transfer nip between the secondary-transfer roller 8 and the driving roller 11 at a predetermined timing.

Toner collected by the respective photoconductor cleaning devices 5 of the process cartridges 40 is transported by the toner conveyance device 50 to a waste-toner bottle 16 disposed inside the apparatus body 101 and stored as waste toner in the waste-toner bottle 16. The waste-toner bottle 16 is removably installable in the apparatus body 101. When the waste-toner bottle 16 is filled to capacity with toner, the waste-toner bottle 16 is replaced. Alternatively, the waste-toner bottle 16 may be returned to the apparatus body 101 after waste toner is discharged therefrom. Each photoconductor cleaning device 5 serves as a collecting device or a conveyance origin from which the toner conveyance device 50 transports toner to the waste-toner bottle 16, serving as a destination container or a collected-toner container, disposed inside the apparatus body 101.

The superimposed black, yellow, cyan, and magenta toner images are transferred to the sheet P in the secondary-transfer nip and fixed thereon by a roller-type fixing device 9 (a fixing process). After the fixing process, the sheet P is transported through a sheet conveyance path R and discharged by a pair of paper ejection rollers 30 to an output tray 31 with an image surface faced down. The fixing device 9 according to the present embodiment is of heating-roller type, in which at least one of rollers facing each other is heated. Alternatively, a heating-belt type fixing device employing a belt may be used.

Next, a configuration and operation of the toner conveyance device 50 are described below.

Figure 2:
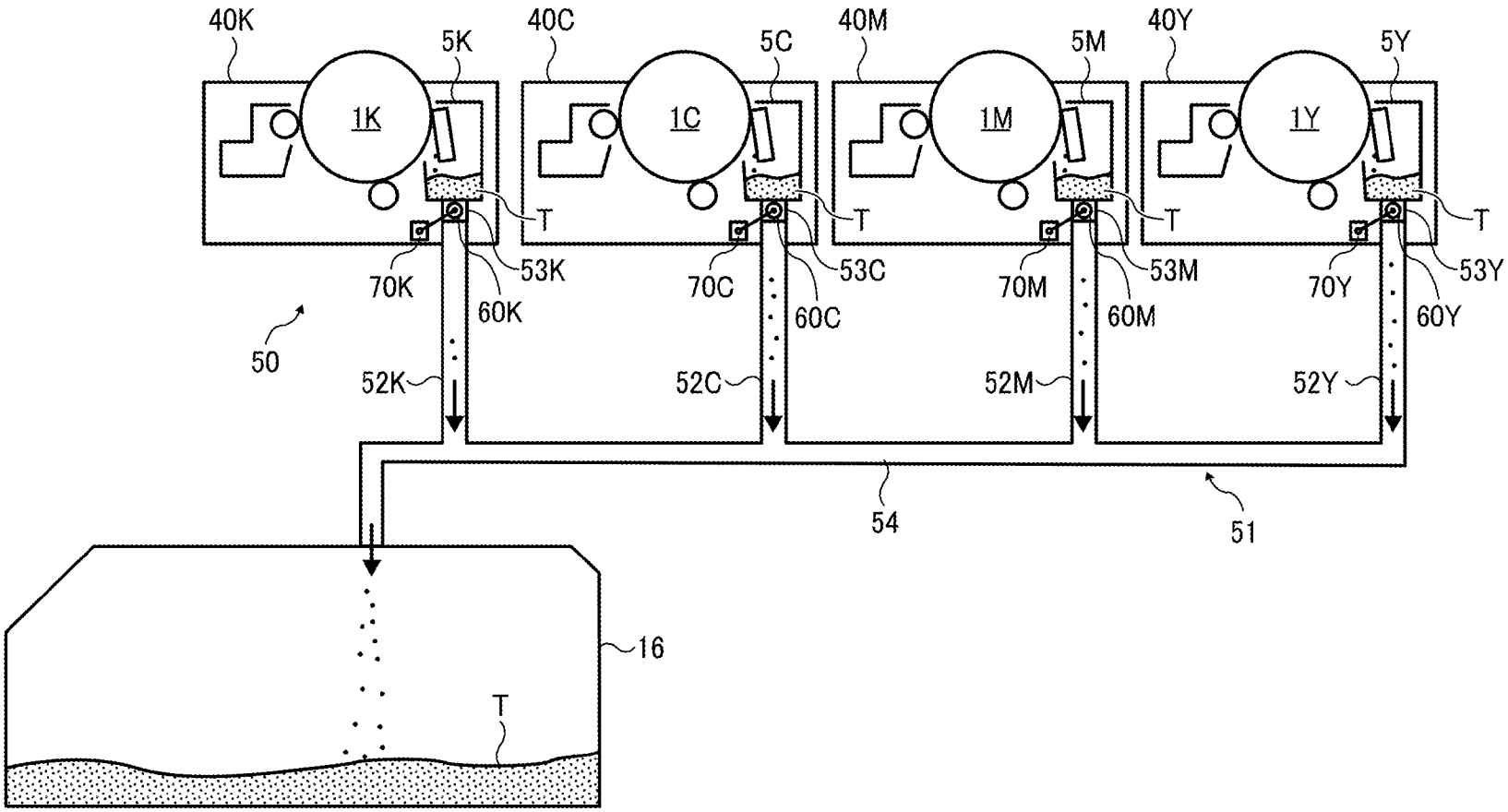
FIG. 2 is a schematic entire view of a toner conveyance device according to an embodiment.

FIG. 2 is a schematic entire view of the toner conveyance device 50.

In FIG. 2, reference character "T" represents collected toner or waste toner, but the reference character is omitted in the description below.

The toner conveyance device 50 is to transport the collected toner from the photoconductor cleaning device 5 to the waste-toner bottle 16 provided inside the apparatus body 101. Referring to FIG. 2, the toner conveyance device 50 includes a conveyance channel assembly 51, conveyors 60Y, 60M, 60C, and 60K provided rotatably in the conveyance channel assembly 51, and driving motors 70Y, 70M, 70C, and 70K to drive the respective conveyors 60Y, 60M, 60C, and 60K. The conveyance channel assembly 51 communicates with the photoconductor cleaning devices 5Y, 5M, 5C, and 5K and the waste-toner bottle 16. The conveyors 60Y, 60M, 60C, and 60K transport waste toner efficiently inside the conveyance channel assembly 51 and inhibit adhesion of toner inside the conveyance channel assembly 51.

The conveyance channel assembly 51 includes first channels 52Y, 52M, 52C, and 52K provided to the apparatus body 101, second channels 53Y, 53M, 53C, and 53K connected to the first channels 52Y, 52M, 52C, and 52K, respectively, and a third channel 54 communicating with the first channels 52Y, 52M, 52C, and 52K and the waste-toner bottle 16. The first channels 52, the second channels 53, the conveyors 60, and the driving motors 70 for the respective colors are similar in configuration, and thus the suffixes Y, M, C, and K are omitted below.

Figure 3:
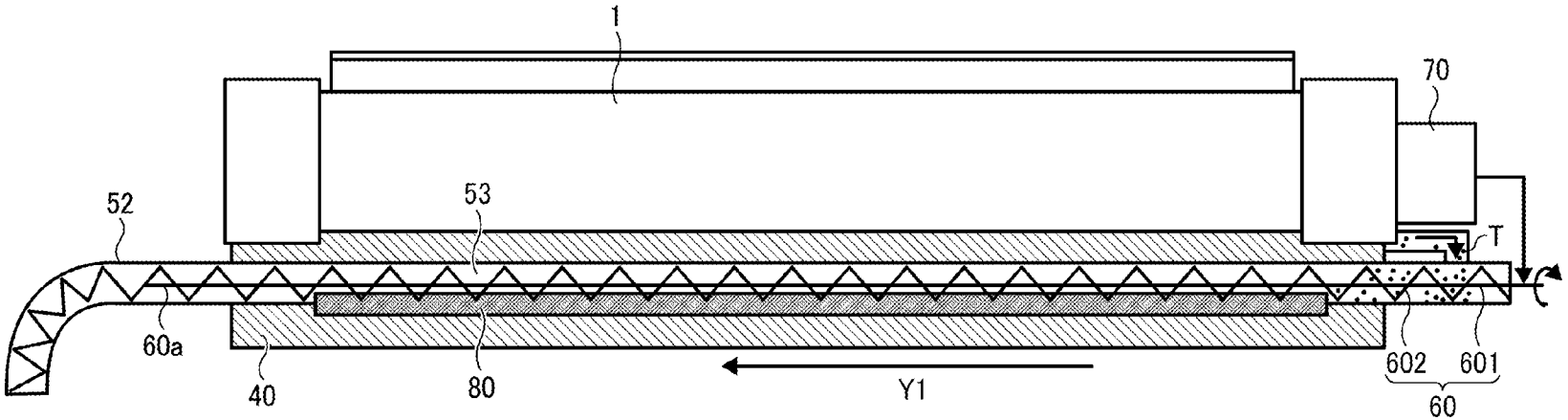
FIG. 3 is an enlarged view of the toner conveyance device illustrated in FIG. 2.

FIG. 3 is an enlarged view illustrating a part of the toner conveyance device 50.

In FIG. 3, reference character "Y1" represents a direction in which toner is transported by the conveyor 60.

Referring to FIGS. 2 and 3, the second channel 53 of the conveyance channel assembly 51 is positioned in a lower portion of the process cartridge 40 and extends in a longitudinal direction of the photoconductor 1. The conveyor 60 disposed in the second channel 53 is, for example, a conveying screw including a shaft 601 and a screw blade 602 provided to an outer circumference of the shaft 601 in the present embodiment. An end of the conveyor 60 is connected to the driving motor 70. As illustrated in FIG. 2, the first channel 52 is disposed in the apparatus body 101 and communicates with the third channel 54 and the second channel 53 provided to the process cartridge 40. The third channel 54 is a single channel into which the four first channels 52 converge.

In the conveyance channel assembly 51, the first channel 52 particularly includes curved portions since the first channel 52 is disposed weaving between components inside the apparatus body 101. Since collected toner (waste toner) is likely to accumulate in the curved portions, an end 60*a* of the conveyor 60 disposed in the second channel 53 is inserted in the first channel 52 in the present embodiment. The conveyor 60 has an outer diameter smaller than an inner diameter of the conveyance channel assembly 51 (the second channel 53 in particular).

The conveyor 60 in the second channel 53 is driven by the driving motors 70 to collect waste toner. While the conveyor 60 rotates, it is possible that the conveyor 60 contacts an inner face 53*a* (in FIG. 4A) of the second channel 53, causing noise, depending on the amount or state of waste toner in the second channel 53. For example, in an initial use of the image forming apparatus 100, waste toner is not present in the conveyance channel assembly 51. In a case where the conveyor 60 rotates in this state, the screw blade 602 at an outer circumference of the conveyor 60 is likely to contact the inner face 53*a* of the second channel 53. Accordingly, it is possible that noise is generated by sliding contact of the conveyor 60. Additionally, since the second channel 53 and the conveyor 60 are separate components, it is difficult to prevent the sound of sliding of the conveyor 60 on the second channels 53 when materials thereof are in direct contact with each other.

As a possible approach to prevent noise, waste toner may be preliminarily introduced into the conveyance channel assembly 51. However, the amount of waste toner to eliminate noise is relatively large and equal to the amount of waste toner arising after solid images of A3 size are formed on 200 sheets. Thus, this approach is not practical for commercial apparatuses.

Figure 4A:
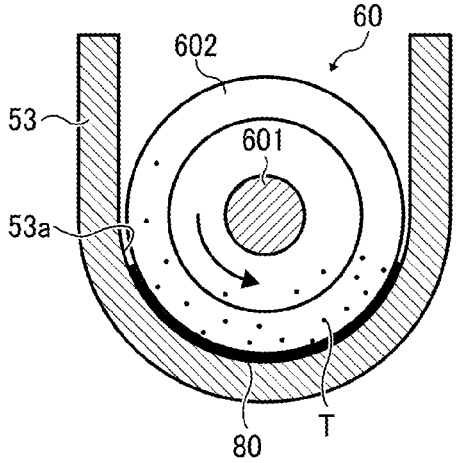
FIG. 4A is a cross-sectional view of an interior of a conveyance channel, as viewed in a direction in which toner is transported.
Figure 4B:
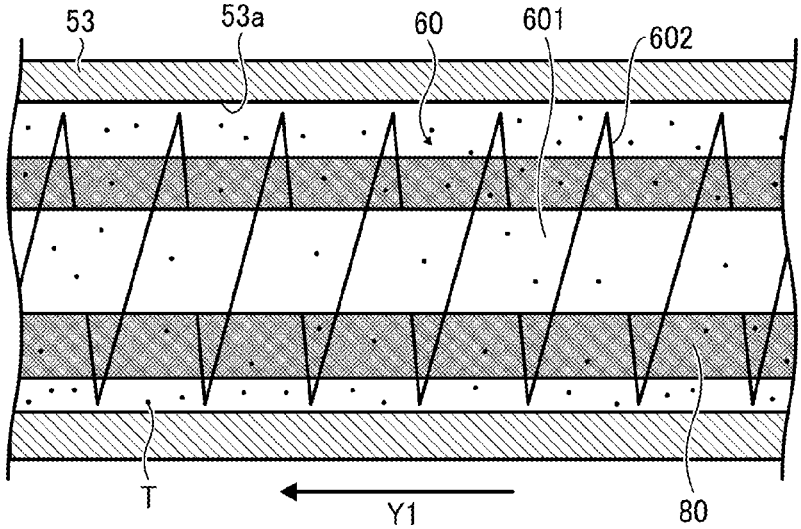
FIG. 4B is a cross-sectional view of the interior of the conveyance channel illustrated in FIG. 4A, as viewed from a photoconductor.

In view of the foregoing, the toner conveyance device 50 according to the present embodiment further includes slide-assist sheet 80 provided to the inner face 53*a* of the second channels 53 that faces the conveyor 60 as illustrated in FIGS. 3, 4A, and 4B.

FIG. 4A is a cross-sectional view of an interior of the second channel 53, as viewed in the direction indicated by arrow Y1 in FIG. 3, in which toner is transported. FIG. 4B is a cross-sectional view of the interior of the second channel 53, as viewed from the side of the photoconductor 1.

The slide-assist sheet 80 is higher in slidability or smoothness than a material of the second channel 53 and that of the conveyor 60. Specifically, the slide-assist sheet 80 is a thin sheet including an adhesive face and attached to, out of the inner face 53*a* of the second channels 53, a portion contactable with the conveyor 60 while the conveyor 60 rotates.

When the slide-assist sheet 80 is thus disposed to, out of the inner face 53*a* of the second channels 53, the portion contactable with the rotating conveyor 60, the screw blade 602 of the conveyor 60 does not directly contact the inner face 53*a* of the second channel 53 while the conveyor 60 rotates. Then the direct contact between the conveyor 60 and the inner face 53*a* is avoided, thereby inhibiting noise that arises in the conveyance channel assembly 51 when the conveyor 60 slidingly contacts the inner face 53*a* during rotation.

Example materials of the slide-assist sheet 80 include, but not limited to, a thin sheet or film such as Lumirror® from Toray, polyethylene terephthalate (PET) resin, and the like. When such a material is used, electrical charges are given to the slide-assist sheet 80 by friction with the conveyor 60. Further, it is preferred that the slide-assist sheet 80 is given electrical charges in a polarity opposite the polarity of waste toner by triboelectric charging with the conveyor 60.

When the slide-assist sheet 80 is charged by friction, waste toner is retained in the second channels 53 by the slide-assist sheet 80. Retaining waste toner in the second channels 53 is advantageous in that waste toner is present therein even when the slide-assist sheet 80 is degraded or the amount of toner collected is extremely small. Accordingly, noise arising from the conveyance channel assembly 51 is inhibited even when the conveyor 60 rotates. Retaining waste toner by the slide-assist sheet 80 is also advantageous in reducing sliding resistance with the conveyor 60, thereby inhibiting wear of the slide-assist sheet 80. Thus, degradation of the slide-assist sheet 80 can be inhibited. The thin slide-assist sheet 80 having the adhesive face can be easily bonded to the inner face 53*a* of the second channel 53, the curved portion in particular, and secured thereto simply by being pressed to the bonded portion. Thus, workability is good.

On the inner face 53*a* of the second channel 53, the area of contact with the screw blade 602 of the conveyor 60 is limited and substantially predefined. Accordingly, noise is suppressed by attaching the slide-assist sheet 80 to not the entire inner face 53*a* but the limited area contactable with the screw blade 602. Additionally, incorporating the second channel 53 and the photoconductor cleaning device 5 in the process cartridge 40, which is removably installable in the apparatus body 101, can facilitate removal, installation, and replacement thereof.

Yet additionally, changing surface roughness of the shaft 601, the screw blade 602, or both of the conveyor 60 to reduce friction is advantageous in suppressing noise arising from the conveyance channel assembly 51 while the conveyor 60 rotates. For example, the surface roughness of the conveyor 60 (the shaft 601, the screw blade 602, or both) is changed by electrolytic machining. As it is known, the surface of the conveyor 60 can be dissolved and polished in electrolytic machining as follows. Soak a negative electrode and the conveyor 60 in an electrolyte capable of oxidation, and induce a direct current therebetween with the conveyor 60 serving as an anode.

The electropolished conveyor 60 has an improved surface smoothness and is advantageous in reducing friction between the inner face 53*a* of the second channel 53 and the conveyor 60, thereby suppressing wear, abrasion, and peeling of the slide-assist sheet 80. This configuration is effective for, not only inhibition of noise arising from the conveyance channel assembly 51 due to rotation of the conveyor 60, but also improvement of durability. Accordingly, recurrence of noise due to peeling of the slide-assist sheet 80 can be prevented.

The first channel 52 of the conveyance channel assembly 51 is situated in the apparatus body 101, whereas the second channel 53 is situated in the process cartridge 40. Accordingly, depending machine type, it is difficult to suppress noise by increasing the diameters of these channels or reducing the rotation speed of the conveyor 60. In other words, there is a limitation in increasing the diameters of the first channel 52 and the second channel 53. When the first channel 52 and the second channel 53 are relatively narrow, the force of contact between the inner face 53*a* and the conveyor 60 is greater. It is possible that, even if the surface roughness of the conveyor 60 is reduced, the surface of the conveyor 60 strongly slides on waste toner in a narrow portion and causes noise. Therefore, it is expected that simply reducing the surface roughness of the conveyor 60 is insufficient in some cases.

In view of the foregoing, occurrence of noise in the second channels 53 during rotation of the conveyor 60 was experimentally observed while changing a surface roughness Ra of the conveyor 60 and that of the slide-assist sheet 80. In the experiment, occurrence of noise during rotation of the conveyor 60 was suppressed when the conveyor 60 was made of a material having a surface roughness Ra of about 13 or lower and the slide-assist sheet 80 was made of a material having a surface roughness Ra of about 1 or lower and a resistivity of about $10^{12}$ Ω·m or greater.

When the conveyor 60 and the slide-assist sheet 80 are made of the above-mentioned materials, occurrence of noise because of small surface roughness can be suppressed. Accordingly, regardless of the material, stainless steel or polyester, charging can be attained because the resistivity is higher than that of polyester.

Conditions and results of the experiment are described in detail.

When the surface roughness Ra of the conveyor 60 was greater than 13, noise occurred. Therefore, to inhibit noise, regardless of material, it is preferred that the surface roughness Ra is 13 or smaller.

According to the experiment, when the surface roughness Ra of the slide-assist sheet 80 is about 1 or smaller, regardless of material, noise is suppressed. Additionally, when the resistivity of the slide-assist sheet 80 is about $10^{12}$ Ω·m or greater, regardless of material, charging is attained.

Figure 5:
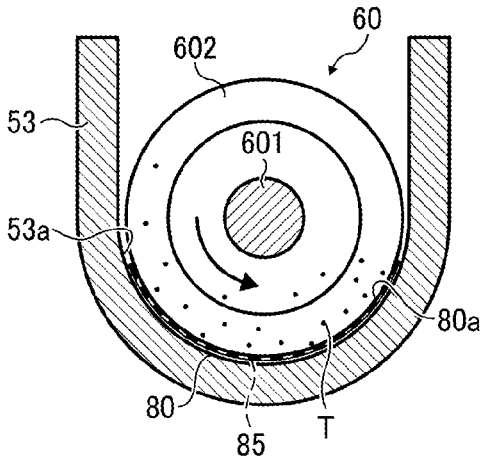
FIG. 5 is a cross-sectional view of a conveyance channel of a toner conveyance device according to another embodiment.

FIG. 5 is a cross-sectional view of the second channel 53 according to another embodiment.

Referring to FIG. 5, in another embodiment, lubricant 85 is applied to an interior of the second channels 53 (in the conveyance channel assembly 51), in which waste toner is transported as the conveyor 60 rotates, in addition to the slide-assist sheet 80. In the configuration illustrated in FIG. 5, by lubricating a surface 80*a* of the slide-assist sheet 80, as indicated by broken lines, wear of the slide-assist sheet 80 caused by contact with the conveyor 60 is effectively reduced. The portion to which the lubricant 85 is applied, however, is not limited to the surface 80*a* of the slide-assist sheet 80. The lubricant 85 may be applied to a portion of the inner face 53*a* from which the lubricant 85 is supplied to a clearance between the surface 80*a* of the slide-assist sheet 80 and the screw blade 602 of the conveyor 60.

It is to be noted that, although the image bearer is the photoconductor 11 and the toner conveyance device 50 is to transport the toner collected by the photoconductor cleaning device 5 to the waste-toner bottle 16 inside the apparatus body 101, in the description above, the toner conveyance device 50 is not limited thereto.

For example, the toner conveyance device 50 is configured to transport the collected toner from, in addition to or instead of the photoconductor cleaning devices 5, the belt cleaner 7 to the waste-toner bottle 16 provided inside the apparatus body 101. In this case, the intermediate transfer belt 6 serves as the image bearer.

Further, the toner conveyance device 50 may be configured to transport toner supplied to the developing device 3. In this case, for example, the conveyance channel assembly 51 communicates with a toner container to contain supplied toner and the developing device 3.

Figure 6:
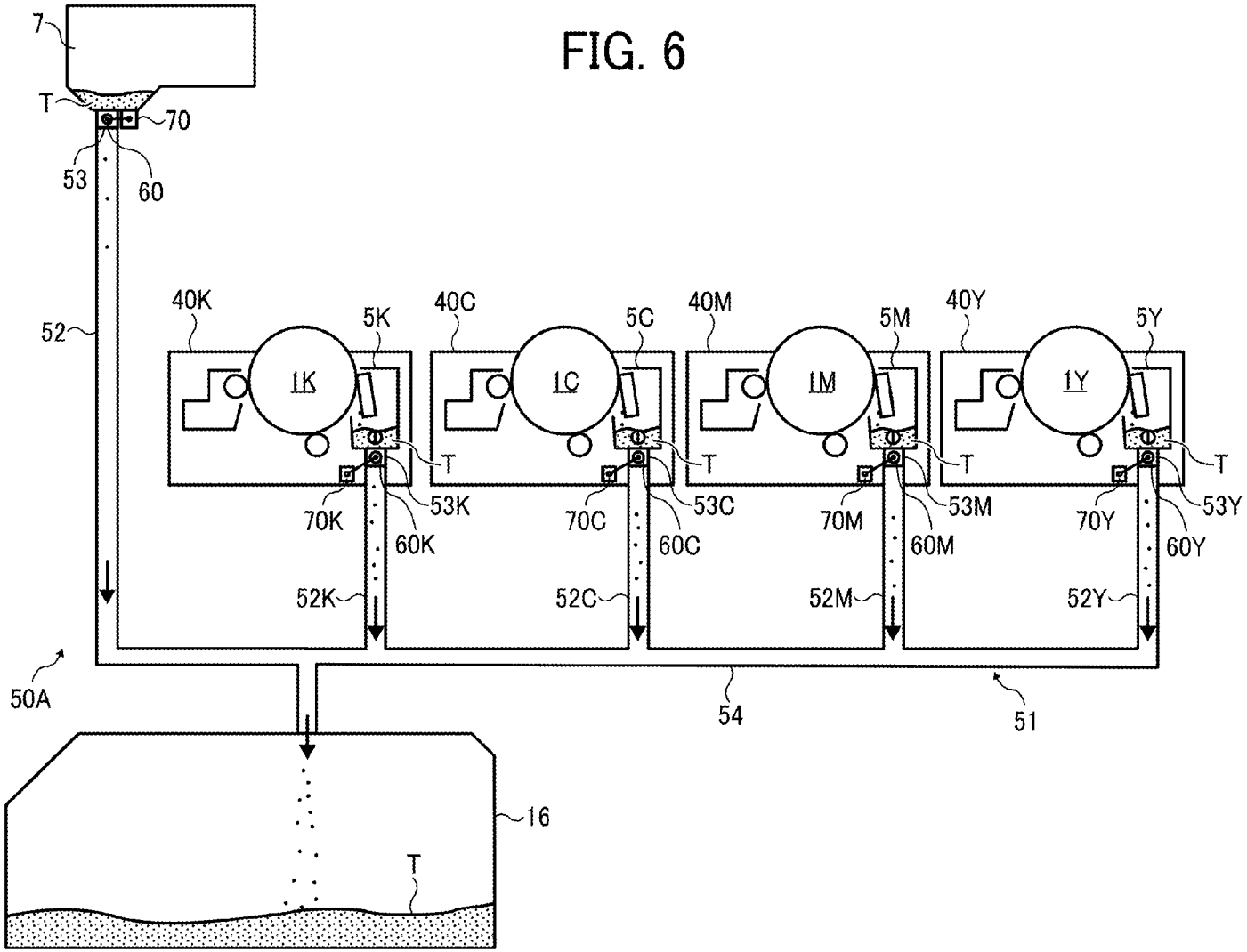
FIG. 6 is a schematic view of a toner conveyance device according to another embodiment.

FIG. 6 is a schematic view of a toner conveyance device 50A according to yet another embodiment.

In the configuration illustrated in FIG. 6, the toner conveyance device 50A transports waste toner to the waste-toner bottle 16 from the belt cleaner 7 in addition to the photoconductor cleaning devices 5. In this case, as illustrated in FIG. 6, the conveyance channel assembly 51, the conveyor 60, and the driving motor 70 are disposed between the belt cleaner 7 and the waste-toner bottle 16 as well. Out of the conveyance channel assembly 51, the second channel 53 is provided in the belt cleaner 7, and the first channel 52 and the third channel 54 are provided in the apparatus body 101. The conveyor 60 is disposed in the second channel 53 and driven by the driving motor 70. The slide-assist sheet 80 described above is provided to the inner face 53*a* of the second channel 53 contactable with the screw blade 602 while the conveyor 60 rotates.

When the slide-assist sheet 80 is thus disposed to, out of the inner face 53*a* of the second channel 53, the portion contactable with the rotating conveyor 60, the screw blade 602 of the conveyor 60 does not directly contact the inner face 53*a* of the second channel 53 while the conveyor 60 rotates. The direct contact between the conveyor 60 and the inner face 53*a* is avoided, thereby inhibiting noise that arises in the conveyance channel assembly 51 when the conveyor 60 rotates while being contact with the inner face 53*a*.

It is to be noted that, although the conveyor 60 includes the shaft 601 and the screw blade 602 in the description above, a coil driven by the driving motors 70 is provided in the second channels 53 in another embodiment. When the coil is used, it is expected that the coil runs riot in the second channels 53 while rotating. Accordingly, it is preferred that the slide-assist sheet 80 is provided to the entire inner face 53*a* of the second channels 53.

According to an aspect of the specification, an inner face of a conveyance channel (such as the second channel 53) that faces a conveyor (such as the conveyor 60) to rotate therein is covered with a slide-assist sheet, and the conveyor does not directly contacts the inner face, and unevenness in lubrication is inhibited. Accordingly, occurrence of noise from the conveyance channel through which toner is transported is inhibited for a long time.

Numerous additional modifications and variations are possible in light of the above teachings. It is therefore to be understood that, within the scope of the appended claims, the disclosure of this patent specification may be practiced otherwise than as specifically described herein. Additionally, effects of the embodiments mentioned above are examples of preferable effects, and effects attained by various aspects of this specification are not limited thereto.

What is claimed is:

1. A toner conveyance device comprising:

a conveyance channel through which toner is transported, the conveyance channel configured to communicate with a conveyance origin and a destination container disposed inside an image forming apparatus;

a conveyor disposed in the conveyance channel configured to rotate in the conveyance channel;

a driving source configured to drive the conveyor; and a slide-assist sheet attached to an inner face of the conveyance channel positioned facing the conveyor, wherein the conveyor includes an electro-polished surface.

2. The toner conveyance device according to claim 1, wherein the slide-assist sheet comprises a material to be charged in a polarity opposite a polarity of the toner by triboelectric charging with the conveyor.

3. The toner conveyance device according to claim 1, wherein the slide-assist sheet comprises a polyester resin sheet including an adhesive surface.

4. The toner conveyance device according to claim 1, wherein the conveyor has a surface roughness Ra of about 13 μm or smaller, and the slide-assist sheet has a surface roughness Ra of about 1 μm or smaller and a resistivity of about $10^{12}$ Ω·m or greater.

5. The toner conveyance device according to claim 1, wherein the conveyance channel comprises a lubricated interior.

6. The toner conveyance device according to claim 1, wherein the conveyance channel is to communicate with a collecting device to collect toner from an image bearer, and the conveyer transports the toner collected from the image bearer through the conveyance channel.

7. An image forming apparatus comprising:

an image bearer;

an image forming device configured to form a toner image on the image bearer;

a collecting device configured to collect toner from the image bearer;

a collected-toner container configured to contain toner collected by the collecting device, the collected-toner container disposed inside a body of the image forming apparatus; and a toner conveyance device configured to transport collected toner from the collecting device to the collected-toner container, the toner conveyance device including:

a conveyance channel through which the collected toner is transported, the conveyance channel configured to communicate with the collecting device and the collected-toner container;

a conveyor disposed in the conveyance channel configured to rotate in the conveyance channel;

a driving source to drive the conveyor; and a slide-assist sheet attached to an inner face of the conveyance channel positioned facing the conveyor, wherein the conveyor includes an electro-polished surface.

8. The image forming apparatus according to claim 7, wherein the conveyance channel comprises:

a first channel disposed in the body of the image forming apparatus; and a second channel connected to the first channel, wherein the second channel and the collecting device are disposed in a process cartridge removably installable in the body of the image forming apparatus.

9. The image forming apparatus according to claim 7, wherein the conveyance channel comprises:

a first channel disposed in the body of the image forming apparatus; and a second channel connected to the first channel, the second channel disposed in the collecting device.

10. The toner conveyance device according to claim 1, wherein the slide-assist sheet is attached to substantially an entire portion contactable with the conveyor.

11. The toner conveyance device according to claim 1, wherein the conveyor includes a shaft and a screw blade.

12. The toner conveyance device according to claim 11, wherein when the slide-assist sheet is attached to the portion contactable with the rotating conveyor, the screw blade of the conveyor does not directly contact an inner face of the conveyance channel.

13. The toner conveyance device according to claim 1, wherein the conveyor and the slide-assist sheet are made from the same material.

14. The toner conveyance device according to claim 13, wherein the conveyor and the slide-assist sheet are made from at least one of stainless steel and polyester.

15. A toner conveyance device comprising:

a conveyance channel through which toner is transported, the conveyance channel configured to communicate with a conveyance origin and a destination container disposed inside an image forming apparatus;

a conveyor disposed in the conveyance channel configured to rotate in the conveyance channel;

a driving source configured to drive the conveyor; and a slide-assist sheet attached to an inner face of the conveyance channel positioned facing the conveyor, wherein the conveyor has a surface roughness Ra of about 13 μm or smaller, and the slide-assist sheet has a surface roughness Ra of about 1 μm or smaller and a resistivity of about $10^{12}$ Ω·m or greater.

* * * * *